US006536612B2

(12) United States Patent
Flores

(10) Patent No.: US 6,536,612 B2
(45) Date of Patent: Mar. 25, 2003

(54) SUPPORT FOR CASKS

(75) Inventor: Sebastián Flores Flores, Navarra (ES)

(73) Assignee: Sagarte, S.A. (ES)

( * ) Notice: Subject to any disclaimer, the term of this patent is extended or adjusted under 35 U.S.C. 154(b) by 0 days.

(21) Appl. No.: 10/094,107

(22) Filed: Mar. 8, 2002

(65) Prior Publication Data

US 2002/0088763 A1 Jul. 11, 2002

Related U.S. Application Data

(62) Division of application No. 09/535,094, filed on Mar. 24, 2000, now Pat. No. 6,360,903.

(30) Foreign Application Priority Data

May 26, 1999 (EP) ..... 99500085
Nov. 17, 1999 (EP) ..... 99500215
Jul. 6, 1999 (EP) ..... 99500111

(51) Int. Cl.[7] ..... A47G 29/00

(52) U.S. Cl. ..... 211/85.22; 211/71.01; 211/194

(58) Field of Search ..... 211/85.22, 71.01, 211/194, 59.4, 85.21, 85.18, 191, 195, 189, 13.1, 151, 162; 410/47–50; 206/504, 509, 511, 512, 446; 220/4.04, 4.07–4.09, 4.29; 108/57.13, 57.22–57.24

(56) References Cited

U.S. PATENT DOCUMENTS 487,765 A * 12/1892 Ormerod
892,083 A * 6/1908 Rawlinson
1,732,829 A * 10/1929 Boardman
1,739,403 A * 12/1929 Lundberg
1,921,222 A * 8/1933 De Lamar
2,334,336 A * 11/1943 Lathrop
2,746,703 A * 5/1956 Enery
2,956,763 A * 10/1960 D'Arca
2,958,492 A * 11/1960 Maynard
2,965,239 A * 12/1960 Rutherford
3,291,073 A * 12/1966 James
3,368,690 A * 2/1968 Konstant
3,476,260 A * 11/1969 Jay
3,502,227 A * 3/1970 Konstant et al.
3,590,752 A * 7/1971 DePew ..... 108/21
3,994,240 A * 11/1976 Berg et al. ..... 220/1.5
4,175,666 A * 11/1979 Smith ..... 211/189
4,239,100 A * 12/1980 Corey ..... 193/35 R
4,239,137 A * 12/1980 Arcouette ..... 206/511
4,382,733 A * 5/1983 Rodgers ..... 410/49
4,391,377 A * 7/1983 Ziaylek, Jr. ..... 211/194
4,421,243 A * 12/1983 Taquoi ..... 220/1.5
4,431,107 A * 2/1984 Bergstrom et al. ..... 211/189
4,523,768 A * 6/1985 Dlubala ..... 211/201
4,567,989 A * 2/1986 Hurst, Jr. ..... 211/194
4,747,495 A * 5/1988 Hoss ..... 211/194
4,771,901 A * 9/1988 Griswold et al. ..... 211/151
4,934,538 A * 6/1990 Beyer ..... 211/49.1
5,044,846 A * 9/1991 Richardson ..... 410/47
5,181,815 A * 1/1993 Haberkorn ..... 410/47
5,228,821 A * 7/1993 Gleffe et al. ..... 410/48

(List continued on next page.)

*Primary Examiner*—Daniel P. Stodola
*Assistant Examiner*—Jennifer E. Novosad
(74) *Attorney, Agent, or Firm*—Brinks Hofer Gilson & Lione; Gregory H. Zayia

(57) ABSTRACT

A support for casks includes a base structure having (a) stanchions which can be disassembled or folded down, (b) complementary intermediate stanchions which can be disassembled or folded down, and (c) pivots or housings for forming mortised connections to the free ends of the stanchions or intermediate stanchions of subjacent supports. The pivots or housings are out of alignment with respect to the stanchions and intermediate stanchions, such that the supports and casks supported thereon are arranged in staggered, parallel rows when stacked. The support can also include a plurality of freely rotating wheels such that the casks seated thereon can be rotated on their axes.

8 Claims, 8 Drawing Sheets

U.S. PATENT DOCUMENTS 5,242,255 A * 9/1993 Gleffe et al. ..... 410/48
5,370,245 A * 12/1994 Tersch et al. ..... 211/74
5,439,152 A * 8/1995 Campbell ..... 224/405
5,603,419 A * 2/1997 Peterson ..... 211/195
5,692,625 A * 12/1997 Filipescu et al. ..... 211/195
5,738,227 A * 4/1998 Duff et al. ..... 211/60.1
5,755,541 A * 5/1998 Suarez ..... 410/36
5,941,398 A * 8/1999 Harris ..... 211/49.1
6,077,005 A * 6/2000 Westlake ..... 410/49
6,123,208 A * 9/2000 Haenszel ..... 211/175
6,279,763 B1 * 8/2001 Bush ..... 211/195

* cited by examiner

A-B

SUPPORT FOR CASKS

This application is a division of application Ser. No. 09/535,094, filed Mar. 24, 2000, now U.S. Pat. No. 6,360, 903, which is hereby incorporated by reference herein.

BACKGROUND

The present invention refers to supports for casks, of special application in large wine cellars, to allow said casks to be grouped together, stably supported in a lying-down position, and without having to bear the weight of those placed on top of them, as the support system is modular and each support is fundamentally conceived to hold a pair of casks placed side by side, and only the supports, in their joined position when they are stacked, bear the weight that is above them, while the casks bear only their own weight.

The purpose of the invention is to succeed in stacking the aforementioned supports so that the casks are positioned in staggered, parallel rows, with the resulting improvement in accessibility to each one of them, both for cleaning as well as for decanting their contents, with no need to move them, at the same time as a substantial improvement is achieved in the esthetic aspect of the wine cellar, while the casks arc arranged in a manner similar to the conventional one.

The purpose of the invention is also to achieve maximum structural simplification of the support, and finally, easy mobility of the casks inside their respective housings, in other words, within the supports, by means of rotating the casks on their own imaginary axes.

In large wine cellars, the process of aging wine in casks is done by grouping them together or stacking them in a lying-down position, in other words, with their bases placed in alignment with vertical planes so that the bottom level of casks rests between pairs of beams placed parallel to each other on the ground, appropriately wedged to prevent them from shifting and to thus achieve a stable positioning of the corresponding casks.

The next levels of casks are formed by resting them on these, in the spaces between them, in other words, so that they are staggered, always chocking them with wedges and stacking them as high as necessary, with the logical limit being the height of the wine cellar.

This stacking system, which is the one that is commonly used in large wine cellars for aging the wine, presents a series of problems and drawbacks, which are the following:

- A lack of safety as far as the stability of the casks is concerned, as said stability is achieved exclusively by means of the wedges, and if they should give way, logically the casks may slide, or in other words, a collapse of the stacks may take place, with the consequent risk of accident for the people who may be working inside the wine cellar, in addition to the economic cost that is involved.
- Casks stacked on top of each other to form levels are difficult to handle.
- Casks located in the lower levels must bear the weight of all the upper levels. Obviously, a cask is manufactured taking into account the function it will perform and the load of its contents when it is full, and so the casks are not usually conceived to bear great weights; thus when they are stacked, and in accordance with what was previously stated, they can become deformed and even damaged.

Trying to eliminate this problem, the applicant himself is the owner of the Spanish utility model with application number U9801070, consisting of a support for casks formed by a rectangular structure, made with longitudinal pieces and crosspieces, on which rods are established on which the casks rest, and coming out of this structure, which constitutes the base of the support, there are stanchions or posts at each of its vertices, which constitute the spacing elements on which the platform or structure belonging to the support which is immediately above rests, when the necessary stacking of the supports, and consequently that of the casks, takes place.

In accordance with the construction of this utility model, the stanchions or posts corresponding to the superposed supports are lined up with each other, and so are the casks, so that if one is trying to achieve optimal use of the available space, the fact that the superposed casks are very close to each other hinders access to them, both for their periodic cleaning and for the customary decanting of wine contained in one of them to a lower position, as access to their openings is drastically reduced by this close proximity. This means that for such actions to be satisfactorily carried out, it is necessary to temporarily unstack the casks, with the resulting negative economic impact that this implies.

SUMMARY

The support for casks that the invention proposes, starting from a basic construction similar to that of utility model 9801070, has been appreciably improved in order to solve the problems that were previously stated.

To do this, more specifically, the characteristics of the new support focus on the fact that, in addition to the four stanchions or posts at the vertices of the base structure, which can still be disassembled or folded to minimize the space occupied by the support when it is not in use or for its storage, it incorporates two other intermediate stanchions, located at the midpoint of its longer sides, i.e., those corresponding to its front and rear faces, with the additional particularity that the means established on the lower face of the base structure to secure the stanchions of the support which is immediately above, instead of being located at the same place as the stanchions of the support itself, are not in alignment with them, but specifically line up with the midpoint of each one of the two halves defined by the intermediate stanch ions, in other words, lined up with the lower polar area of the pair of casks placed on the support.

Thanks to this special construction, when the support system is assembled or stacked, each support is substantially out of alignment in a longitudinal sense both with respect to those above and to those below, which means that the casks are arranged in staggered, parallel rows, or in other words, that the upper polar area of each cask is aligned with the space between the two casks immediately above it, in other words, in a situation which allows optimal accessibility.

The special arrangement of the casks in staggered, parallel rows, in addition to being a substantial approximation of the typical arrangement in which the casks are stacked directly on top of each other, allows greater accessibility to the entire perimeter of each one, both for cleaning operations and for decanting their contents, as was previously stated, to which must be added the additional benefit, also resulting from this arrangement, that the elevation of the stanchions may be appreciably reduced, resulting in better use of the space available.

In accordance with another of the characteristics of the invention and the aim of structurally simplifying the support, it has been foreseen that the aforementioned base structure, from which the also aforementioned six stanchions come out, be replaced by four feet, appreciably prismatic and quadrangular in shape, provided with an upper transverse opening to allow the load arms of a forklift or similar device to pass through, and on the bottom with a receptacle whose opening faces downwards, to form a mortised connection between supports when the latter are stacked, with a frame made up of metal tubes coming out of each foot, the same as the foot itself, a frame whose lower part forms the shape of an inverted trapezoidal isosceles section, of the appropriate dimensions so that the end of the cask can fit inside it, resting on the central part of its side branches; and an upper section made up of a pair of stanchions that come out of the ends of the trapezoidal section and which, being parallel to each other and vertical when in working position, allow free passage of the casks to their resting place and act as spacers between supports, having a rounded upright on their free end so that they can be introduced into the lower receptacles of the feet belonging to the support which is immediately above.

This inner receptacle of the feet tapers upward, with a dihedral profile, for example, and has an opening of considerable dimensions, so that this special shape facilitates the handling of the support using, for example, the aforementioned forklift, as it is not necessary to achieve perfect alignment when stacking the supports; as long as the end of each stanchion is within the opening of the corresponding foot, the upper support will center itself as it descends upon the lower support.

Four frames form part of the support as a whole, one for each one of the four feet: two in front, which are secured to each other at their adjacent stanchions, by welding, for example, and two others in back, secured in a like manner; at the same time, the two forward frames are attached to the rear ones by means of crosspieces located at the level of the union between its trapezoidal sections and its upper stanchions.

In accordance with this construction, the feet on which the support rests allow it to stand perfectly on the ground as well as to form a mortised connection on top of other supports when the latter are stacked; the casks rest directly on the frames which make up the structure itself of the support, with no need for specific means for that purpose; and the typical base platform practically disappears, inasmuch as the means for holding or stabilizing the casks themselves are what basically make up the structure of the support, with the resulting greater accessibility to the upper area of each cask.

Complementing this notable structural simplification and the greater accessibility to the upper area of each cask, in this variation in the embodiment of the support, the characteristic of the first embodiment relating to the arrangement of the casks in staggered, parallel rows when the supports are stacked is maintained.

In either of the two aforementioned cases, and in accordance with another of the characteristics of the invention, it has been anticipated that the casks rest on the support itself by means of pairs of wheels mounted on short arms leaving them freedom of movement, so that, as said wheels are where the cask rests, they allow the latter to be freely rotated on its own axis with minimal effort, thus achieving easy mobility at those times when it is necessary to check the cask, when because of diminution or leakage it is necessary to refill it, to facilitate the removal of the wine during the decanting process, and finally, to allow the cask to be cleaned "in situ" with no need to move it, as its opening can be oriented sideways or downwards, also with a minimum of effort.

Obviously, said wheels should be strong enough to bear the weight of the cask, and at the same time, made of a material soft enough so as not to mark or damage the cask's surface, both when it is in a stable position and when it is subjected to a rotating movement.

BRIEF DESCRIPTION OF THE DRAWINGS

To complement this description and for the purpose of allowing for better understanding of the characteristics of the invention, in accordance with the example of its preferred embodiment, a set of drawings of an illustrative and non-restrictive nature, in which the following items are represented, is attached as an integral part of this description.

DETAILED DESCRIPTION OF THE PRESENTLY PREFERRED EMBODIMENTS

Figure 1:
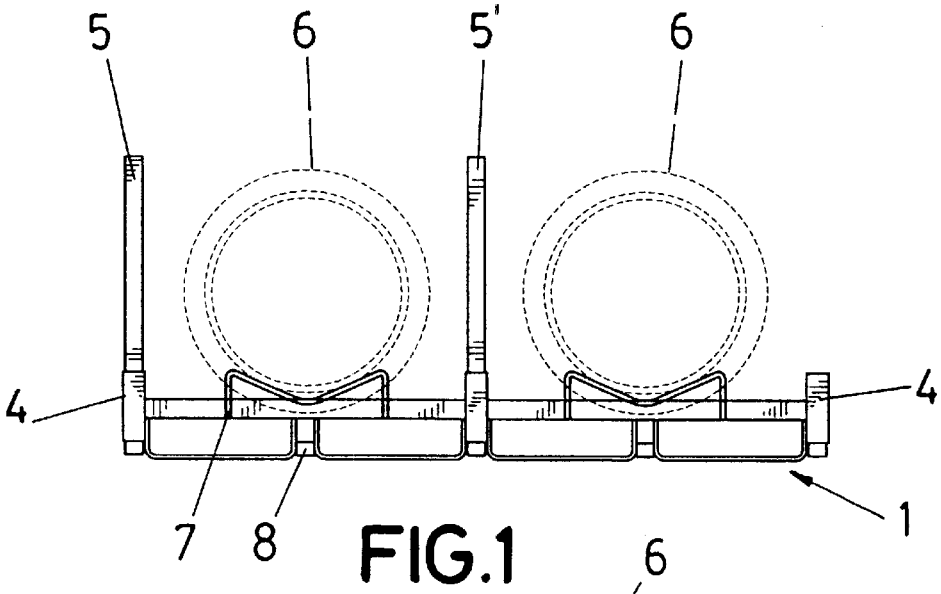
FIG. 1.—Shows a schematic representation of the front view of a support for casks, produced in accordance with the present invention, on which the two casks it has been intended for are represented by dotted lines.
Figure 2:
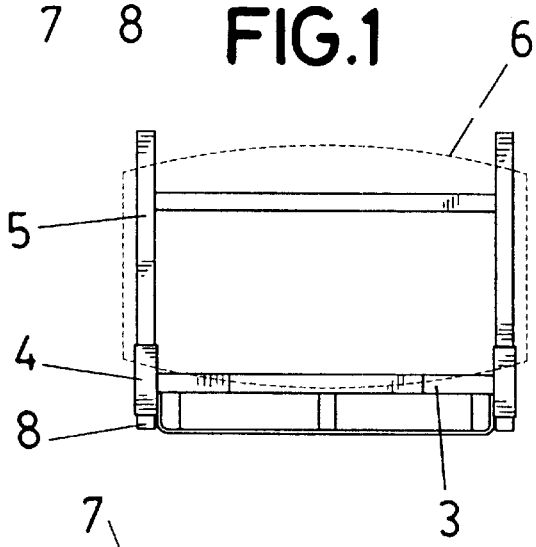
FIG. 2.—Shows a side view of the ensemble represented in the previous figure.
Figure 3:
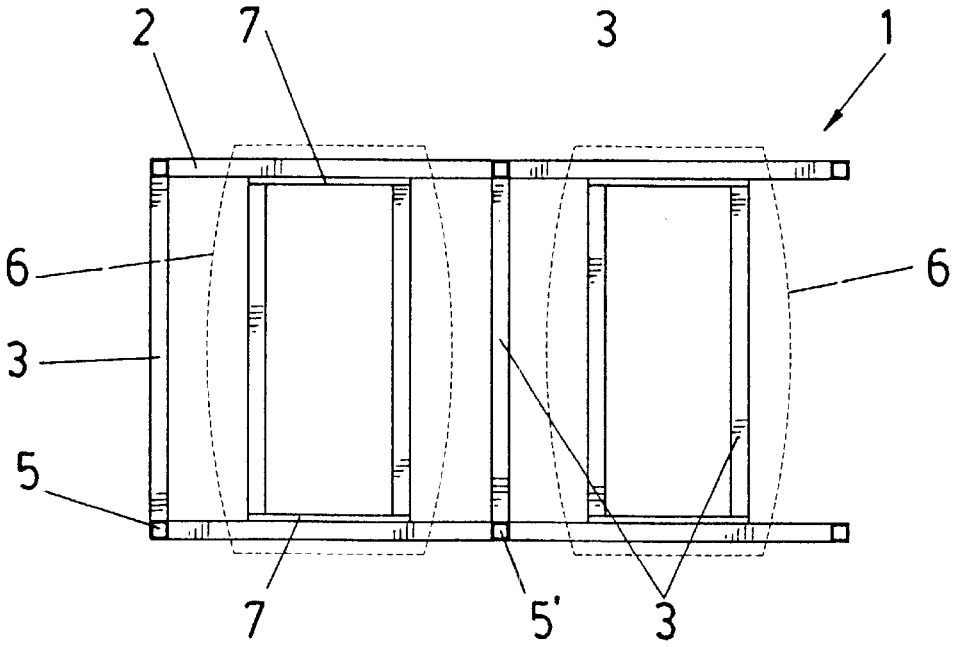
FIG. 3.—Shows a plan view of the same ensemble.

In looking at these figures, and more specifically at FIGS. 1 to 4, it can be seen how the support for casks which the invention proposes is made starting with a base structure (1) formed by longitudinal pieces (2) and crosspieces (3), which make up a type of hollow, rectangular platform, at whose vertices short, vertical, tubular elements (4) are established, upon which stanchions (5) can be fitted, which constitute spacing elements when the supports are stacked, although these stanchions (5) may fold down instead of being removable, in either case to reduce the volume of space the support occupies when not in use.

According to the invention, the characteristics of the support focus on the incorporation of a pair of intermediate stanchions (5') which delimit the area where each cask (6) is located; said casks rest on the base structure with the aid of rods (7), which are appropriately shaped so that they stabilize said casks.

As a complement to the structure described, the base structure (1) incorporates pivots (8) on its lower face, or in their place, housings, designed to form a mortised connection with the upper end of the stanchions (5–5') of the supports located below, with the particular characteristic, as especially observed in FIG. 1, that these mortised joining elements (8) are not in line with the stanchions (5–5') of the support itself, but specifically are located midway between each pair of adjacent stanchions (5–5'), so that when the supports are stacked, as can especially be observed in FIG. 4, the supports are distributed in staggered, parallel rows and, consequently, the casks (6) are also arranged in this manner.

Figure 4:
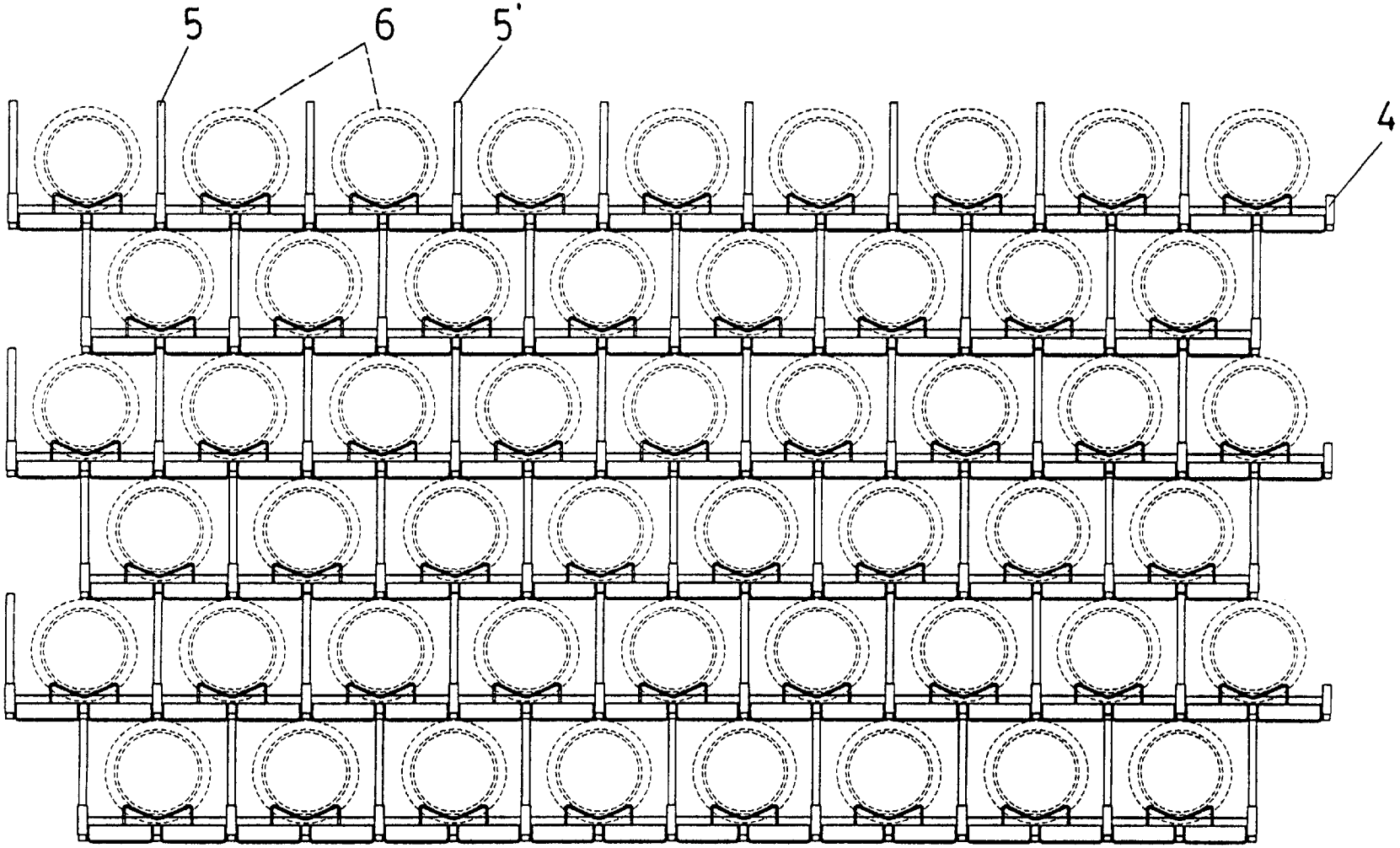
FIG. 4.—Shows a schematic representation of the front view of a large number of supports like that of FIG. 1, duly interconnected, forming a stack of longitudinal rows.
Figure 5:
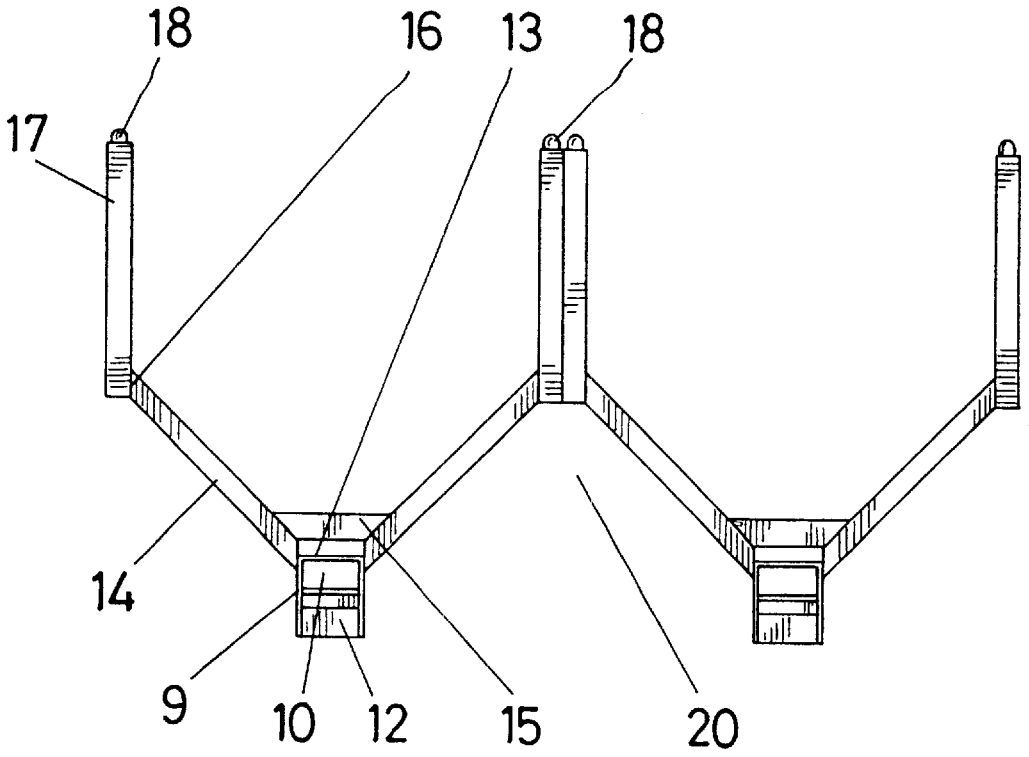
FIG. 5.—Shows a front view of a variation in the embodiment of the support, in which its structure has been noticeably simplified with respect to the structure represented in the previous figures.
Figure 6:
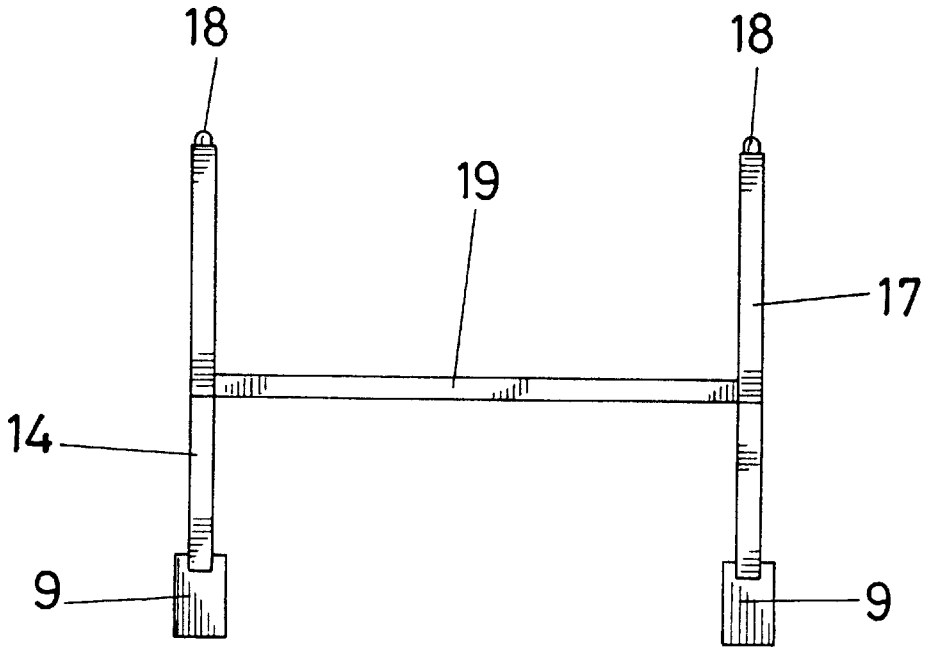
FIG. 6.—Shows a side view of the support of the previous figure.
Figure 7:
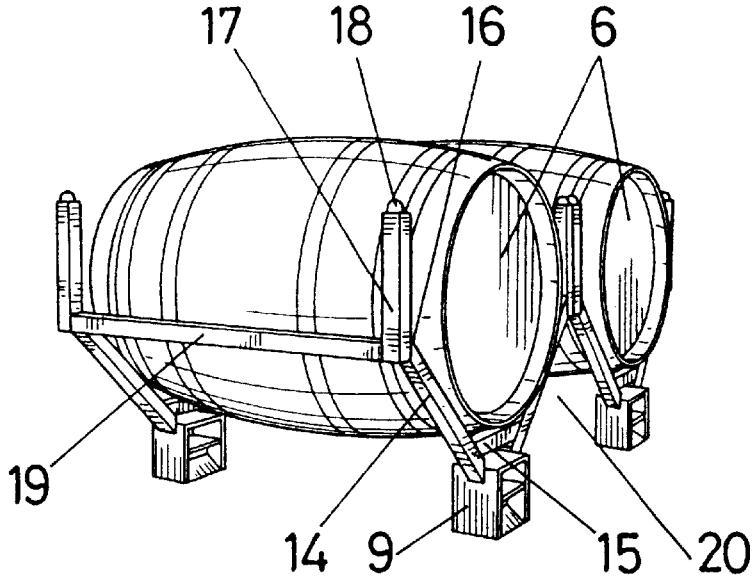
FIG. 7.—Shows a perspective view of the support of FIGS. 5 and 6, in this case holding a pair of casks.
Figure 8:
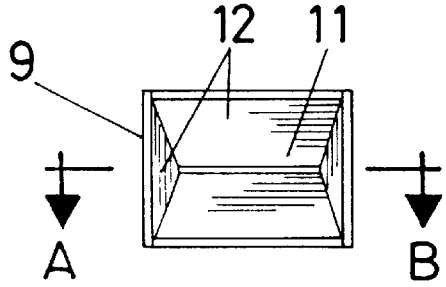
FIG. 8.—Shows a plan view of the underside of one of the feet that form part of the support of the previous figure.
Figure 9:
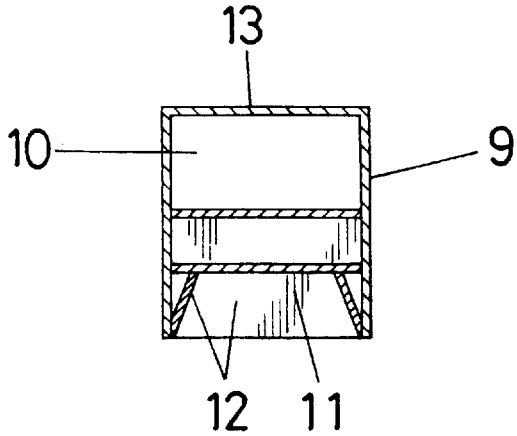
FIG. 9.—Shows a cross section of the foot of FIG. 8, shown as cut along line A–B of said figure.

As can also be seen in FIG. 4, this special arrangement of the casks, resulting from the likewise special configuration of the support proposed in this invention, means that the upper and lower ends of each cask are laterally out of line to the maximum degree with respect to the adjacent casks, resulting in optimum accessibility to each of the casks (6), both for cleaning them as well as for decanting their contents. In addition, and as has also been previously mentioned, as two casks (6) are never superposed on each other, but rather completely out of alignment, the stanchions (5–5') can be appreciably shorter than they could otherwise be, reducing the elevation of the support as a whole and, consequently, reducing the volume it occupies when assembled, as shown in FIG. 4, which allows better use of the available space in the wine cellar.

Nevertheless, the structure of the support can be simplified, as the practical embodiment in FIGS. 5 to 9 shows, so that the aforementioned base structure (1) is replaced by four feet (9) which are basically prismatic and rectangular in shape, in which there is an ample upper opening (10) of the appropriate dimensions to allow easy entry of the load arms of a forklift for handling the support as a whole, with or without its load; and on each foot (9), under this opening (10), a housing (11), open on the bottom and tapering upwards, defined, for example, by means of a series of internal partitions (12) which make up the lateral surface of a rectangular pyramid; these receptacles or pyramidal housings (11) on the feet have the specific purpose of centering the supports when they are stacked, and properly stabilizing them in a crosswise direction.

A frame is joined to the top face (13) of each foot (9), formed by two lower tubes (14) which are upwardly divergent, which make up a first section which is trapezoidal and isosceles in shape, and inverted, of the appropriate dimensions to hold the corresponding end of the respective cask (6), so that the cask makes tangential contact with the midsection of the aforementioned tubes (14), which can be steadied on their lower ends by means of a crosspiece (15) and whose upper ends (16) are slightly further apart than the maximum diameter of tile casks (6) for which the support is intended, and which have other tubes (17) secured to the aforementioned upper end (16) of the divergent tubes (14); these other tubes (17) rise vertically and parallel to each other, and have a rounded appurtenance (18) on their free end. These vertical tubes (17) act as spacing elements when the casks are stacked, and for this purpose they should be of the right length so that, in combination with the height added by their feet, the supports and consequently, the casks, are properly separated in height.

Each foot (9) with its corresponding frame (14–17) is secured on the same plane to another identical ensemble, as the support is designed for two casks (6), and this pair of frames with their feet, situated, for example, at the front of the support, are joined to another back pair with the aid of crosspieces (19), suitably secured at the area where said frames inflect (16), and whose length in turn is close to that of the axial contour of the casks (6), so that the ends of the latter can rest on the respective frames (14).

Thus, in the present case, the divergent tubes (14) make up the fixed, physical resting place equivalent to the rods (7) in the embodiment of FIGS. 1 to 4, at the same time as the tubes (17) have the same function as the stanchions (5) in this case; with this second embodiment, a support is obtained in which four feet (9) take part, which can be set directly on the ground, lending said support and its load perfect stability and, in addition, allowing such supports to be easily stacked by joining the upper free end of the vertical tubes (17) to the feet (9) belonging to the supports above; these feet arc markedly oversize, which allows for perfect self-centering thanks to the pyramidal frustum shape or similar shape of the receptacles (11) which said feet are provided with, and also allows for perfect transverse stability, as the supports are forced to adopt an unaligned transverse position which in turn forces the same lack of alignment in the casks (6), providing each one of them with optimal accessibility to their upper area, not only because of the lack of lateral alignment with respect to the two casks immediately above, but also because the support itself does not interfere with access to said area, which is substantially open because of the shape of the support structure itself, and more specifically because of the ample triangular space (20) defined between each pair of frames (14) of the support.

Figure 10:
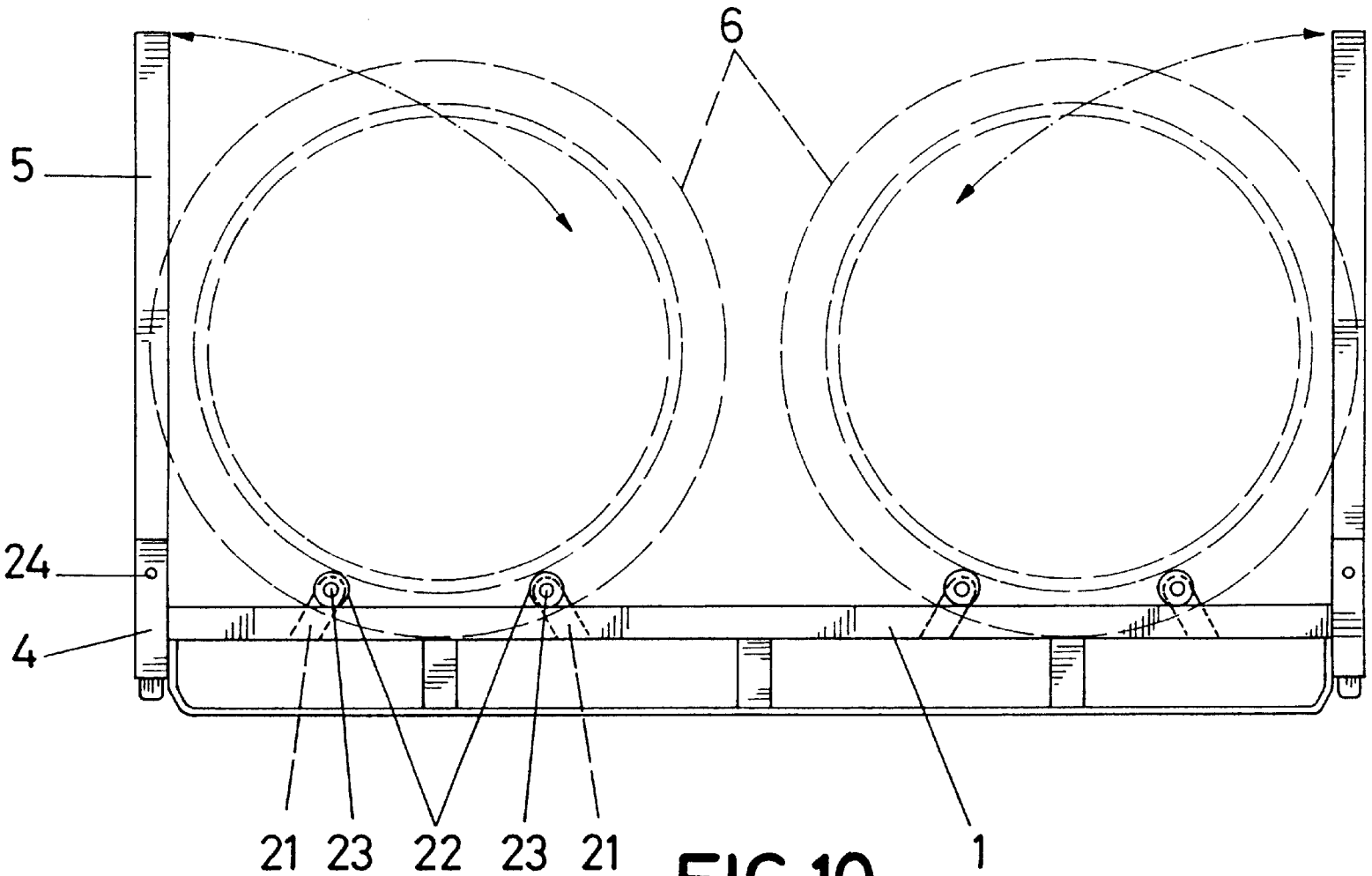
FIG. 10.—Shows a front-view of a support similar to that represented in FIG. 1, in which the rods which constitute the fixed resting place of the casks have been replaced by wheels which facilitate rotating the casks on their own axes.
Figure 11:
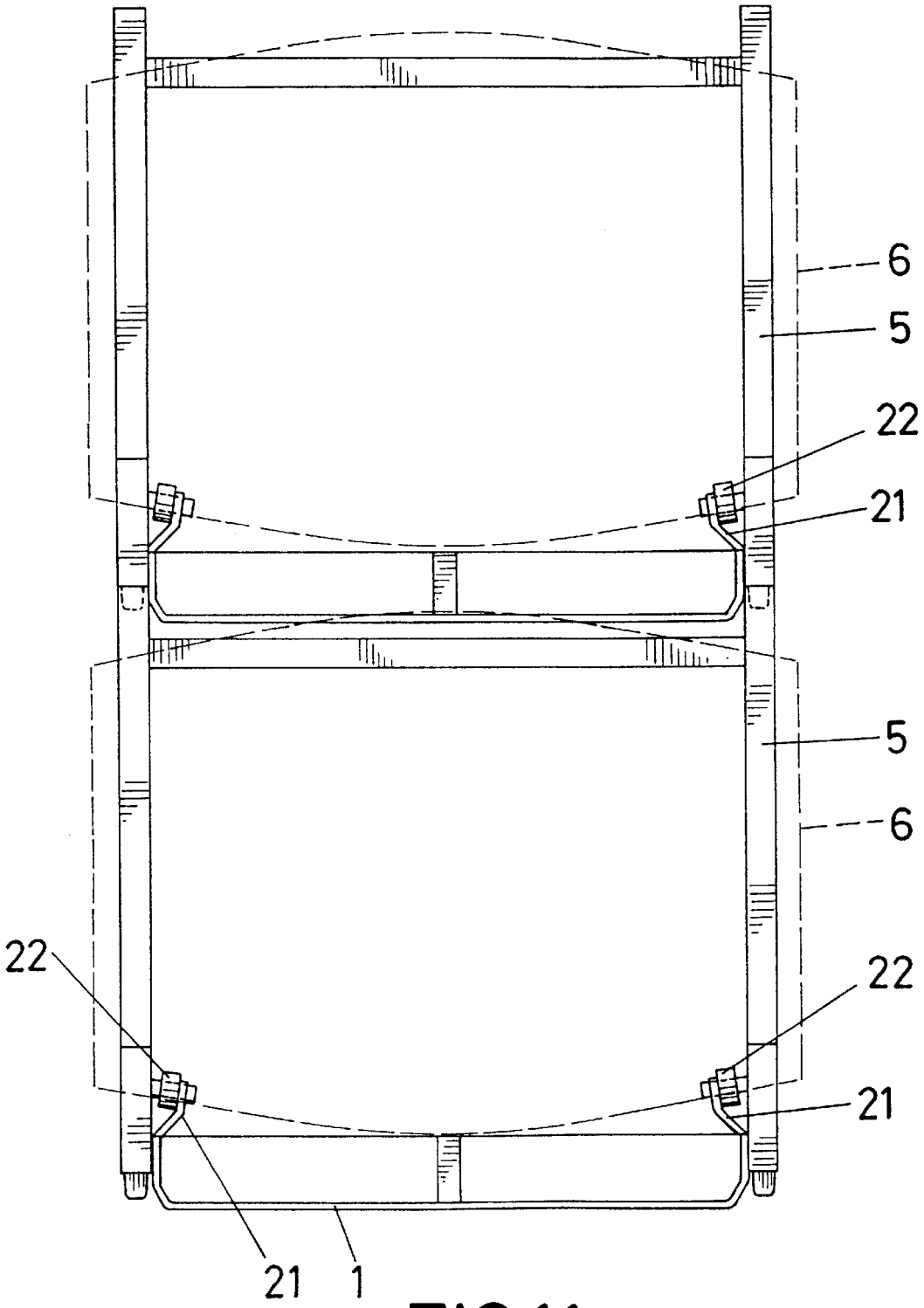
FIG. 11.—Finally, shows a schematic plan view of the ensemble represented in the previous figure.
Figure 12:
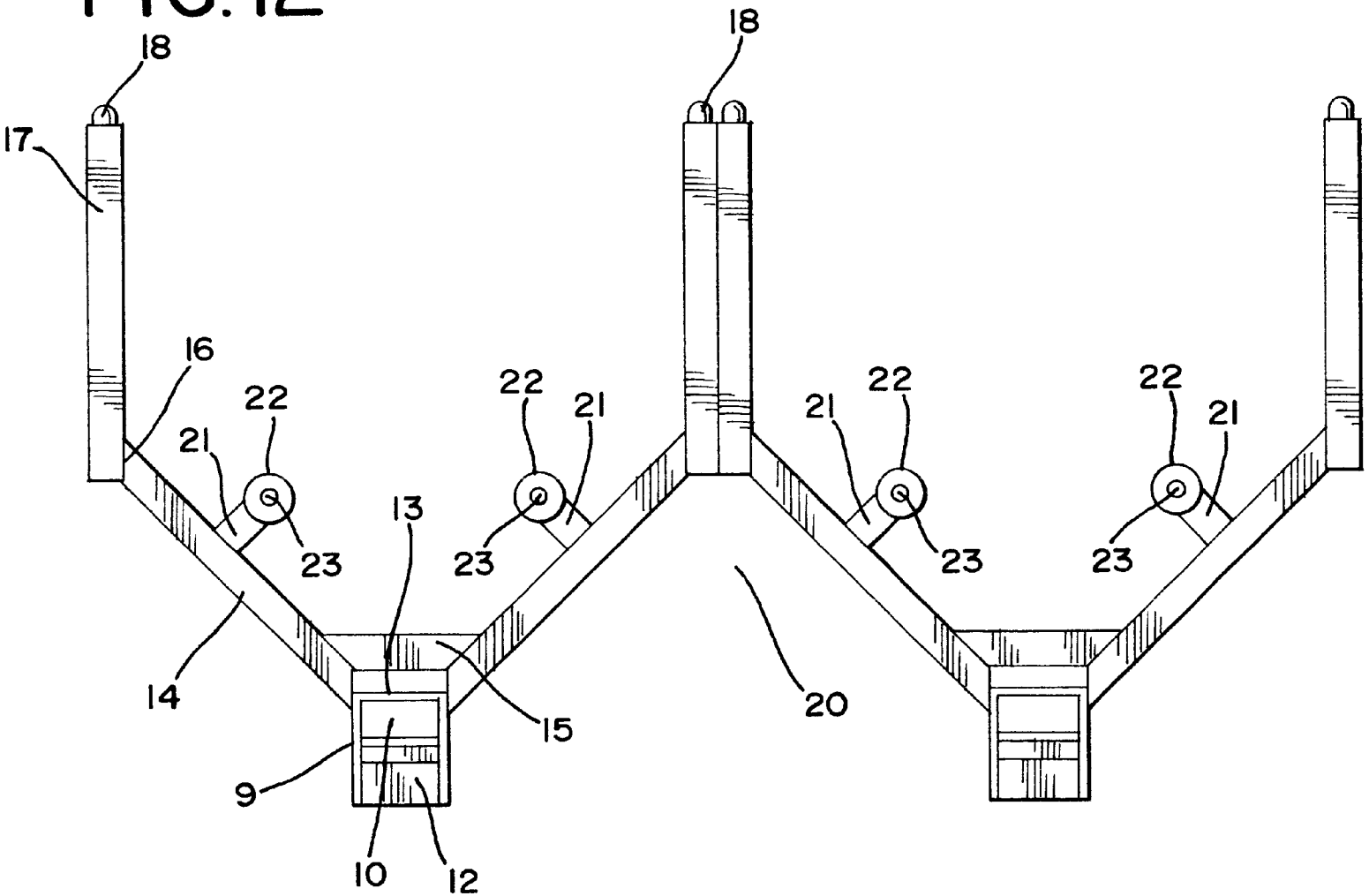
FIG. 12.—Shows a front view of a support similar to that represented in FIG. 5 in which the upwardly divergent lower tubes, which constitute the fixed resting place of the casks, has been fitted with wheels which facilitate rotation of the casks on their own axes.
Figure 13:
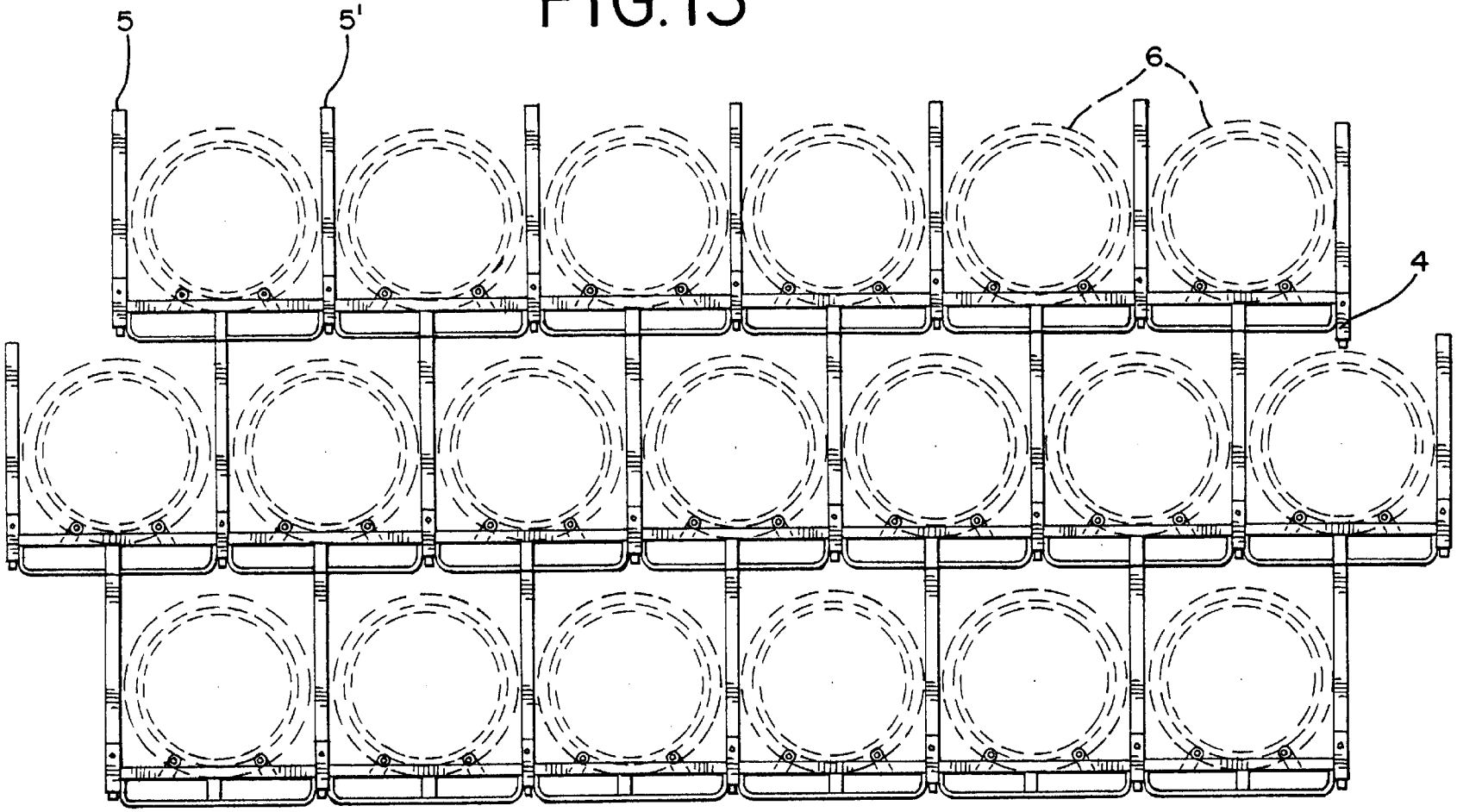
FIG. 13—Shows a schematic representation of the front view of a large number of supports like that of FIG. 10, duly interconnected, forming a stack of longitudinal rows.

Finally, and in accordance with another of the characteristics of the invention, in either of the two previous cases, as for example in the first one, as shown in FIGS. 10 and 11, the rods (7) that constitute the fixed resting place for the casks (6) can be replaced by pairs of arms (21) so that the arms in each pair are symmetrically arranged with respect to the imaginary vertical diameter of the cask (6) in the latter's anticipated position; each one of these arms (21) terminates in a wheel (22), mounted so that it has freedom to rotate and which constitutes the point where the cask (6) rests, so that each cask rests on four wheels, as can especially be observed in the plan in FIG. 11 and is thus perfectly stabilized, but with the possibility of rotating on its own axis with the application of minimal effort.

The arms (21) will preferably be in an inclined position, appreciably radial with respect to the cask (6) they are to hold, for the purpose of improving force transmission towards the structure or base (1) due to the weight of the cask and its contents.

In addition, the spindles (23) of the wheels (22) should also adopt a slanting position, so that they are parallel to the imaginary tangent of the cask at the point where the wheel makes contact with it.

As has also been previously mentioned, the wheels (22) should be of a material that is strong enough to bear the stress to which they will be subjected, but at the same time soft enough so as not to mark the outer surface of the cask, both when the latter is resting on the wheels in a stable position and when it its subjected to a rotating movement on its own axis.

Finally, the stanchions (5) are joined to the base structure (1) by means of articulated joints (24) which allow them to be tilted between two extreme positions, one of being tilted over the base structure (1) itself, corresponding to a position for storage and transport, and consequently the inoperative position of the support, and the other as represented in FIG. 10, a vertical position, which under no circumstances can be exceeded towards the outside. In this sense, as FIG. 10 shows, the pins (24) on which the stanchions (5) tilt may be located appreciably above their lower end, so that said lower end rests against the end (side) of the base structure (1), which acts as a stop to prevent said stanchions from tilting outwards, although any other system for articulating and stopping them which establishes the aforementioned limits may also be used.

In this case, and given that the accessibility of the casks is a result of their ease of rotating movement, it is not necessary for there to be intermediate stanchions (5'), although these could also be used when it is foreseen that the casks (6) will be set up in staggered, parallel rows.

What is claimed is:

1. A support for casks comprising:

a) a base structure having a front face, a rear face, an upper face, and a lower face, said base structure comprising a rectangular platform having four vertices, first and second pairs of stanchions which can be disassembled, said first and second pairs of stanchions being disposed along said front and rear faces, respectively, such that one of said stanchions occupies each of said four vertices, and first and second intermediate stanchions which are complementary to said stanchions, and which can be disassembled, said first and second intermediate stanchions being disposed along said front and rear faces, respectively, substantially halfway between each of said first and second pairs of stanchions; and b) first and second means for forming a mortised connection with a stanchion or an intermediate stanchion of a subjacent support for casks, such that when said support for casks is stacked on top of said subjacent support for casks, a top portion of said stanchion or said intermediate stanchion of said subjacent support for casks engages one of said first and second means; wherein said first and second means for forming a mortised connection are on said lower face of said base structure, and are disposed along said front and rear faces, respectively, substantially halfway between one of said stanchions and one of said intermediate stanchions adjacent thereto;

c) a plurality of arms; and d) a plurality of freely rotating wheels; wherein said wheels are mounted on a first end of said arms; and a second end of each of said arms is joined to said base structure, such that said casks can be seated on said wheels, thereby enabling said casks to be rotated on their own axes.

2. The support of claim 1, wherein said arms are slanted radially with respect to said cask, so as to provide optimal force transmission towards said base structure.

3. The support of claim 1, wherein said wheels comprise spindles which are parallel to a tangent to said cask at a point where said cask rests on said wheels.

4. The support of claim 1, wherein said wheels are comprised of a material which does not cause marks on said casks when said casks are in either a stable position or are subjected to a rotating movement.

5. A support for casks comprising:

a base structure comprising four feet, four frames, and at least two crosspieces, wherein said frames comprise two upwardly divergent lower tubes, and two vertical upper tubes, wherein each of said vertical upper tubes is connected to an end portion of one of said upwardly divergent lower tubes, and wherein said feet are adapted to rest on a ground surface or on another of said supports;

each of said frames is joined to one of said feet; and said upper tubes are perpendicular to a plane defined by an upper surface of said feet; and wherein a first pair of said frames are situated in a first plane, and are secured to each other by an adjacent pair of said vertical tubes;

a second pair of said frames are situated in a second plane, wherein said second plane is parallel to said first plane; and said second pair of said frames are connected to said first pair of said frames by said crosspieces;

a plurality of arms; and a plurality of freely rotating wheels; wherein said wheels are mounted on a first end of said arms; and a second end of each of said arms is joined to said base structure, such that said casks can be seated on said wheels, thereby enabling said casks to be rotated on their own axes.

6. The support of claim 5, wherein said arms are slanted radially with respect to said cask, so as to provide optimal force transmission towards said base structure.

7. The support of claim 5, wherein said wheels comprise spindles which are parallel to a tangent to said cask at a point where said cask rests on said wheels.

8. The support of claim 5, wherein said wheels are comprised of a material which does not cause marks on said casks when said casks are in either a stable position or are subjected to a rotating movement.

* * * * *